US005755657A

United States Patent [19]

Millson

[11] Patent Number: 5,755,657

[45] Date of Patent: May 26, 1998

[54] CENTRIFUGAL OIL FILTER

[75] Inventor: Matthew Millson, Hemblington, Great Britain

[73] Assignee: The Glacier Metal Company Limited, England

[21] Appl. No.: 628,663

[22] PCT Filed: Nov. 2, 1994

[86] PCT No.: PCT/GB94/02401

§ 371 Date: Apr. 12, 1996

§ 102(e) Date: Apr. 12, 1996

[87] PCT Pub. No.: WO95/13141

PCT Pub. Date: May 18, 1995

[30] Foreign Application Priority Data

Nov. 9, 1993 [GB] United Kingdom ..... 9323093
Jun. 27, 1994 [GB] United Kingdom ..... 9412847

[51] Int. Cl.[6] ..... B04B 9/06

[52] U.S. Cl. ..... 494/49; 494/901; 210/360.1

[58] Field of Search ..... 494/24, 43, 49, 494/901, 64; 210/360.1, 380.1, 232, 416.5

[56] References Cited

U.S. PATENT DOCUMENTS

| | | | |
|---|---|---|---|
| 4,221,323 | 9/1980 | Courtot | 494/49 X |
| 4,346,009 | 8/1982 | Alexander et al. | 494/901 X |
| 4,400,167 | 8/1983 | Beazley et al. | 210/360.1 X |
| 4,498,898 | 2/1985 | Haggett . | |
| 4,557,831 | 12/1985 | Lindsay et al. . | |
| 4,787,975 | 11/1988 | Purvey | 210/360.1 |
| 4,871,458 | 10/1989 | Purvey | 210/377 X |
| 5,096,581 | 3/1992 | Purvey | 210/232 |

FOREIGN PATENT DOCUMENTS

| | | | |
|---|---|---|---|
| 0 193 000 | 9/1986 | European Pat. Off. . | |
| 2 049 494 | 12/1980 | United Kingdom . | |
| 2160449 | 12/1985 | United Kingdom | 494/49 |
| 2 160 796 | 1/1986 | United Kingdom . | |
| 86/06984 | 12/1986 | WIPO | 494/83 |

*Primary Examiner*—Charles E. Cooley
*Attorney, Agent, or Firm*—Nixon & Vanderhye P.C.

[57] ABSTRACT

A rotor for a centrifugal separator includes a casing with an internal separation cone which defines an annular, radial opening between the cone and a central support tube. The area in $mm^2$ of the radial opening between the cone and central tube is on the order of 60–120 times the throughput of the separator in liters/minute.

5 Claims, 2 Drawing Sheets

CENTRIFUGAL OIL FILTER

TECHNICAL FIELD

This invention concerns lubricating oil cleaning assemblies for engines particularly internal combustion engines. Servicing engines and particularly car and truck engines is a labour-intensive operation which needs to be done rapidly so disposable oil-cleaning units need to be used wherever possible.

Conventionally, oil is filtered by interposing a "full flow" filter medium, typically paper, in the path of all of the oil flow delivered by the engine lubricating oil pump. Centrifugal separators, which are now in more common use than was previously the case, act essentially as by-pass oil cleaning devices, because they usually treat only part of the oil flow from the pump, typically up to about 10% of the total, prior to returning the treated oil direct to the sump.

Full flow filter elements designed to remove fine contaminants through the use of very fine filter media pores do tend to become clogged and their performance deteriorates with time. However, centrifugal separators do not utilise filter media and their performance remains virtually constant with time.

Although disposable centrifugal separators have been proposed, they have been of the spin-on type which depends from a mounting in the same way as disposable full flow filters. However, because centrifugal separators normally drain by gravity to the sump, a second pipe connection at their lower end has had to be provided which is a serious drawback.

In some preferred arrangements, the centrifugal separator itself is not disposable but the rotor is. This is because a disposable rotor should preferably be non-disassemblable and tamper-proof, which helps prevent ingress of dirt during maintenance.

One example of a centrifugal separator is found in patent No GB 2,160,796B in which there is provided an oil cleaning assembly for an engine, comprising a centrifugal separator unit and a filter unit which each have a casing releasably connected at one end to a mounting means in such a way that the casings may be independently removed from the mounting means, and which both have an oil inlet and an oil outlet at said end, the centrifugal separator unit being arranged to extend substantially vertically upwards from the mounting means and being of the kind in which oil to be treated is introduced into the interior of a substantially closed rotor under pressure and leaves the rotor through a pair of nozzles disposed such that the reaction force from the oil discharged causes the rotor to spin about a substantially vertical axis. The mounting means also provides a common oil supply passage for the separator unit and filter unit, whereby oil flows in parallel through both the separator unit and the filter unit at all times when oil flows through said passage, a drain passage for draining oil from the separator unit to the engine sump and a discharge passage from the filter unit for supplying oil to the engine lubrication system. The rotor is driven only by the oil flow through the nozzles and not by any external drive means.

In the arrangement just described, the rotor base immediately above the nozzles usually includes a separation cone in the form of a frustum of a cone whose base is downwardly directed and attached at its periphery to the inner wall of the rotor at or adjacent the base thereof and whose upper rim or apex is spaced apart from a central support tube for the rotor. The separation cone thus partially divides the rotor into two separate, but communicating chambers, one of which is relatively large and constitutes the upper part of the rotor which receives the detritus from the oil. The other, or lower chamber is relatively small, serving primarily to define a space from which the oil escapes via the nozzles. Fluid escapes from the upper chamber by flowing firstly down the rotor wall and then up the surface of the separation cone, to an annular clearance space defined between the apex of the cone and the central support tube. It thereafter passes into the lower chamber, prior to escaping through the nozzles. The size of the apertures through the latter determine the throughput of the entire unit.

For example, patent specification GB-2,049,494-A discloses a typical centrifugal separator of the kind described above and having a throughput of oil of the order of about 12.5 liters/minute. The separator inlet diameter quoted is about 3.2 mm (⅛ inch) whilst the outlet (discharge) aperture is said to be in the range from about 25.4 mm (1 inch) up to 38 mm (1½ inch). The area of the inlet would thus be about 10 $mm^2$ and the area of the outlet from about 500 $mm^2$ to about 1150 $mm^2$. However, it is important to appreciate that the actual throughput of the separator must all flow from inlet to outlet through the nozzles, which in known centrifugal separators have a diameter in the range from 1 mm to about 3 mm, the corresponding area for a typical two nozzle unit being from about 1.5 $mm^2$ to 15 $mm^2$. Thus the nozzle area controls the separator throughput and the size of the outlet is chosen simply to ensure that the separator casing will drain freely under gravity into the engine sump, without risk of flooding the separator casing.

It will be appreciated that the separation cone is located upstream of the nozzles and that because of the considerably greater area of the annular gap between the inner rim of the separation cone and the central support tube in comparison to the area of the nozzles, the area of the annular gap has no effect at all on throughput. Unless the area of the annular gap is made comparable to the area of the nozzles, the latter will always control the throughput. If the area were to approach that of the nozzles, the separator would probably cease to function.

SUMMARY OF THE INVENTION

Given that in any practical centrifugal separator, the annular gap in question has no effect on throughput, it has now been discovered that it does have a very significant effect on the cleaning efficiency of the separator as a whole. Thus, the presence of the separation cone itself is advantageous because it prevents detritus from falling directly into the nozzle area, as well as causing a change of direction of oil flow inwardly towards the central support tube before it can escape via the nozzles. The resulting serpentine flow path gives more opportunity for detritus to be trapped on the inner wall of the rotor. However, it has now been discovered that improved efficiency in separating detritus can be accomplished by a modified separation cone construction.

According to the present invention, a centrifugal separator of the kind described includes a separation cone located upstream of the nozzles of the rotor wherein the area in $mm^2$ of the aperture defined between the surface of the central tube and the upper rim or apex of the cone is in the range from about 60 to 120 times the separator throughput in liters/minute.

It will be appreciated that the area of the aperture is the area of the annulus defined by the radial clearance between the central tube and the confronting upper rim of the separation cone. Advantageously the range is from about 70 to 110 times the throughput in liters/minute, with a particularly preferred range of 85–95.

It has been found that the use of an aperture area as specified results in a substantial improvement in cleaning efficiency, the improvement for a single passage through the centrifugal separator being typically from about 30% with a conventional aperture to around 50% with an optimised aperture according to the present invention. This is achieved despite the fact that the throughput (determined by nozzle size) remains essentially constant.

In order that the invention be better understood, a preferred embodiment of it will now be described by way of example with reference to the accompanying Figures.

DETAILED DESCRIPTION OF THE DRAWINGS

Figure 1:
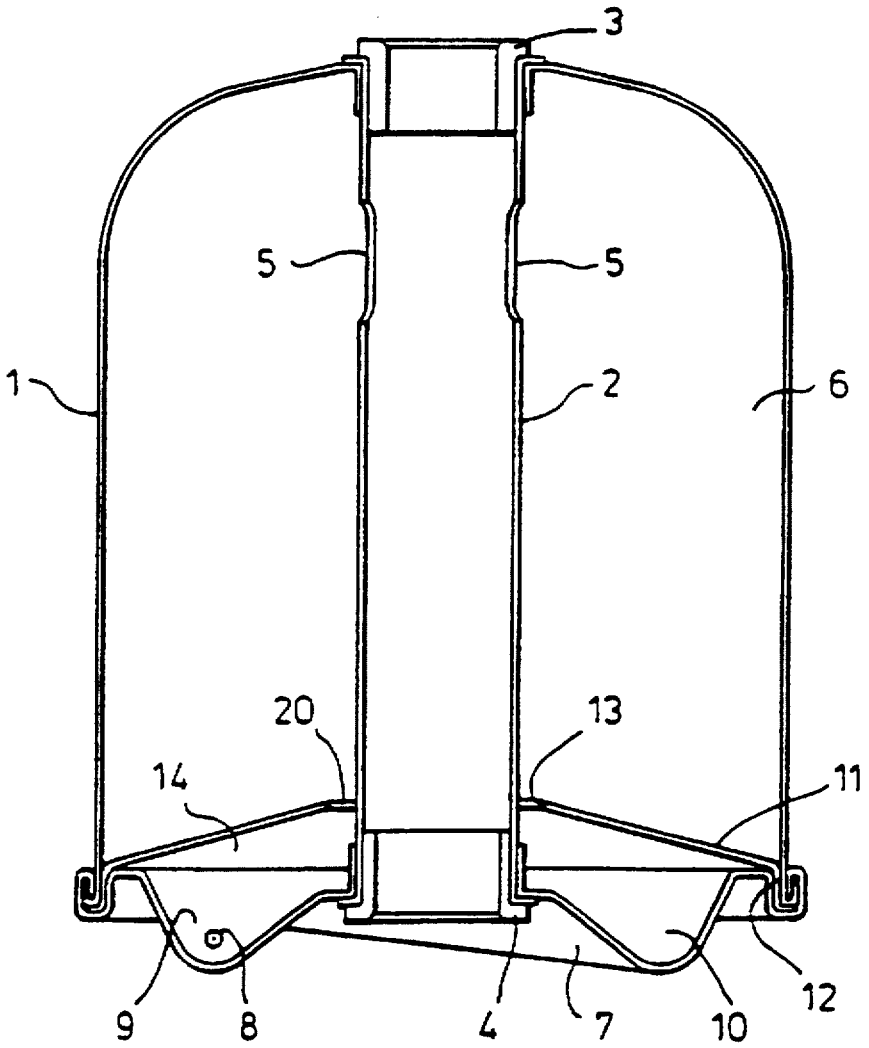
Fig. 1 (Prior Art)
FIG. 1 is a cross-sectional side view through the rotor of a typical centrifugal separator including a separation cone.

In FIG. 1, a cylindrical rotor comprises an outer casing 1, a central tube 2 provided with bearings 3, 4 and a plurality of apertures 5 through which fluid can enter an upper chamber 6 defined between the casing and the central tube.

The lower part of the casing is closed by a pressed metal base plate 7 provided with a pair of tangentially directed nozzles 8 (only one of which is seen in FIG. 1). These are located in arcuate recesses 9, 10 (formed into the base plate 7).

Immediately above the base plate 7 there is a separation cone 11. The base periphery of this is clamped at its radially outermost edge 12 between the casing 1 and the base plate 7 where the latter items meet. The radially innermost part (the apex) of the cone terminates in a rim 13 which is spaced apart from the central tube 2 to define a radial gap 20. The separation cone thus defines with the base plate 7 a lower chamber 14 which communicates with the upper chamber 6 through the gap 20.

In use, the operation of a centrifugal separator fitted with the rotor of FIG. 1 is perfectly conventional. Contaminated fluid is admitted through the central tube via its lower end and enters the upper chamber 6 through the apertures 5, the top of the tube being sealed by a bearing cap assembly (not shown) which locates the top end of the rotor for rotation in the separator unit. Fluid entering the upper chamber 6 can only escape via the radial gap 20 between the rim 13 of the cone 11 and the confronting wall of the central tube 2. Fluid following this route into the lower chamber 14 can only escape via the tangentially directed nozzles 8 and it is the flow through these which causes the rotor to spin about the axis of the central tube.

In accordance with this invention the area of $mm^2$ of the radial gap 20 was dimensioned in the range 85 to 95 times the throughput of 6 liters/minute. To demonstrate the effect of changing the gap 20, tests were carried out using standard conditions as regards oil, contaminant and flow rate. Thus a highly filtered oil of viscosity 10 CSt was contaminated with fine dust to a level of 5 million particles (less than 5 μm effective diameter) per liter. A 24 liter reservoir of oil was used with a flow rate of 6 liters/minute under a pressure of 4 bar for each test.

Figure 2:
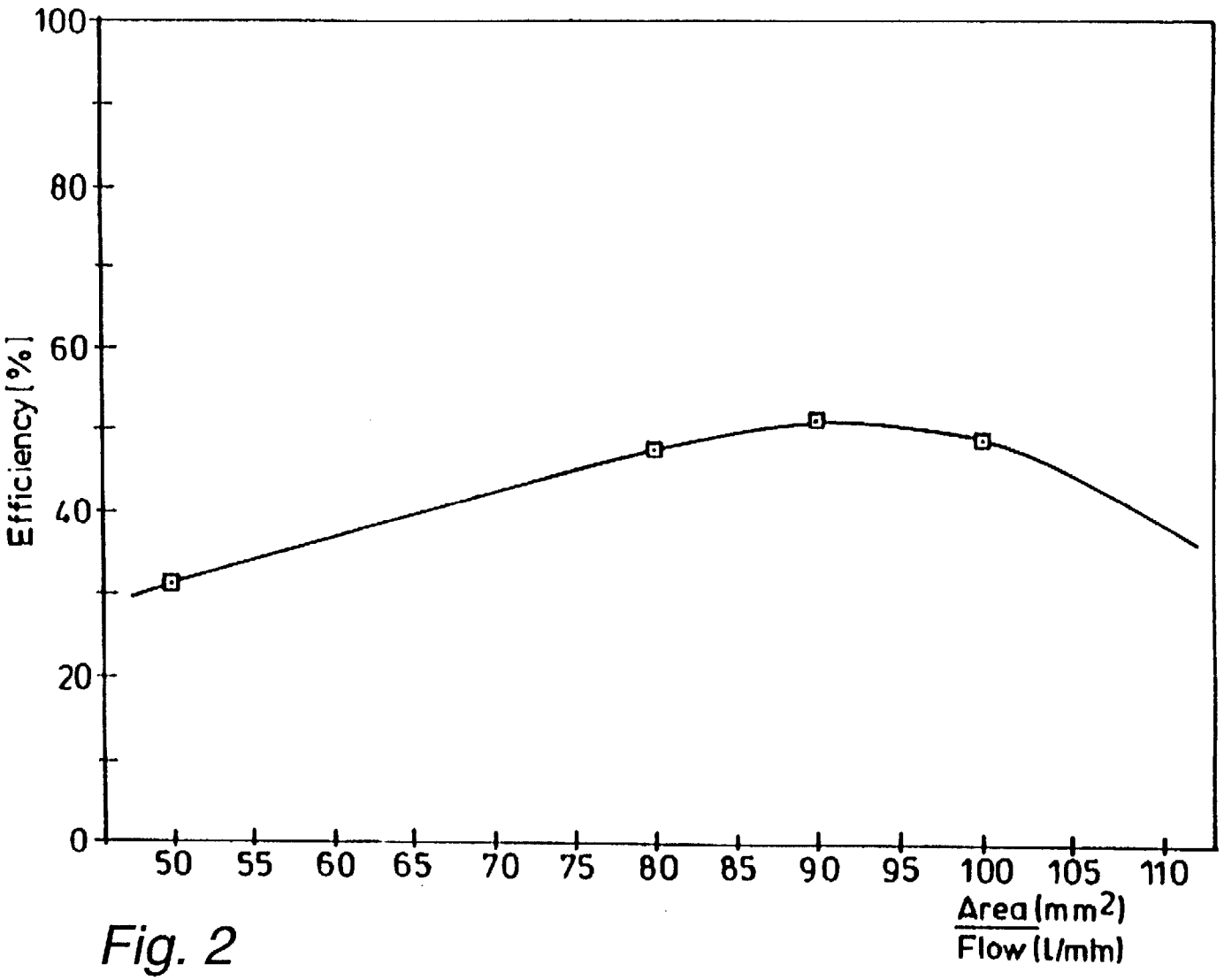
FIG. 2 is a graph illustrating the effect on efficiency of changing the clearance between the rim of the separation cone of FIG. 1 and the central tube of the latter Figure.

A series of different separation cones were used with different radial gaps 20 (giving different areas) in a standard rotor configuration and the number of contaminant dust particles per 100 ml was monitored with respect to time until the level fell to 10% (500,000) of its original value. The results were plotted to give the graph of FIG. 2 (clearing efficiency/radial gap area), from which it can be seen that changing the radial gap 20 into the preferred range resulted in a significant (20%) increase in cleaning efficiency over a conventional gap size which was in common use.

I claim:

1. A rotor for a centrifugal separator comprising a casing having an inlet connectable to a source of fluid under pressure and an outlet connectable to a fluid sump, the casing mounted on a central support tube within said casing for rotation about an axis extending between said inlet and said outlet, said support tube having at least one aperture in communication with said inlet, said outlet constituted by at least one nozzle generally tangentially disposed relative to said axis, said at least one nozzle determining a throughput for the fluid under pressure, whereby fluid passing from said inlet through said at least one aperture to said outlet will cause said rotor to spin about said axis; a separation cone located inside the casing and constituted by a frustum of a cone extending downwardly in a radially outward direction, with a lower periphery of the cone attached to a wall of said casing at or adjacent a lower end thereof, and wherein an upper rim of said cone is spaced radially apart from an adjacent surface of said central support tube to thereby define an annular radial opening therebetween, said separation cone serving to divide the rotor into two chambers in communication via said annular opening, one of said chambers being relatively large and constituting an upper part of the rotor wherein detritus from the fluid accumulates through operation of the separator, and the other of said chambers being relatively small and constituting a fluid reservoir from which fluid escapes through said at least one nozzle, wherein the area in $mm^2$ of the annular radial opening is in the range from about 60 to 120 times greater than the throughput of the fluid under pressure in liters/minute.

2. The rotor for a centrifugal separator according to claim 1 wherein the area of said annular radial opening is in the range of from about 70 to 110 times the throughput of the fluid under pressure in liters/minute.

3. The rotor for a centrifugal separator according to claim 1 wherein the area of said annular radial opening is in the range of from about 85 to 95 times the throughput of the fluid under pressure in liters/minute.

4. The rotor for a centrifugal separator of claim 1 wherein two tangentially disposed nozzles are provided in the other of said chambers, and wherein the area of said annular radial opening is in the range from 70 to 110 times the throughput of the fluid under pressure in liters/minute.

5. The rotor for a centrifugal separator of claim 4 wherein the area of said annular radial opening is in the range from 85 to 95 times the throughput of the fluid under pressure in liters/minute.

* * * * *